US009350087B2

(12) United States Patent
Fink et al.

(10) Patent No.: US 9,350,087 B2
(45) Date of Patent: May 24, 2016

(54) METHOD FOR PRODUCING AN ELECTRIC INTERFACE AND INTERFACE

(75) Inventors: Dieter Fink, Rosenberg (DE); Hans Michael Finke, Elztal-Auerbach (DE)

(73) Assignee: Franz Binder GmbH + Co. Elektrische Bauelemente KG, Neckarsulm (DE)

( * ) Notice: Subject to any disclaimer, the term of this patent is extended or adjusted under 35 U.S.C. 154(b) by 183 days.

(21) Appl. No.: 13/582,641

(22) PCT Filed: Mar. 1, 2011

(86) PCT No.: PCT/DE2011/000203

§ 371 (c)(1),
(2), (4) Date: Sep. 17, 2012

(87) PCT Pub. No.: WO2011/107075

PCT Pub. Date: Sep. 9, 2011

(65) Prior Publication Data

US 2012/0329323 A1 Dec. 27, 2012

(30) Foreign Application Priority Data

Mar. 1, 2010 (DE) ..... 10 2010 009 766

(51) Int. Cl.
*H01R 43/00* (2006.01)
*H01R 4/04* (2006.01)
(Continued)

(52) U.S. Cl.
CPC .. *H01R 4/04* (2013.01); *H01R 4/00* (2013.01); *H01R 4/58* (2013.01); *H01R 9/032* (2013.01); *H01R 9/05* (2013.01); *H01R 13/035* (2013.01); *H01R 43/16* (2013.01)

(58) Field of Classification Search
USPC ..... 29/592.1, 830, 832, 841, 848, 854, 856, 29/858, 876, 883; 264/104; 439/79, 86, 439/91.66, 488, 491, 567, 591, 597, 607.1
See application file for complete search history.

(56) References Cited

U.S. PATENT DOCUMENTS 4,408,089 A * 10/1983 Nixon ..... 174/34
5,225,066 A * 7/1993 Drew ..... 205/85
(Continued)

FOREIGN PATENT DOCUMENTS

CN 1089399 A 7/1994
CN 1264937 A 8/2000
(Continued)

OTHER PUBLICATIONS

The State Intellectual Property Office of the P.R.C., First Office Action for Application No. 201180022046.8, Jul. 3, 2014, 15 pages, China.
(Continued)

*Primary Examiner* — Paul D Kim
(74) *Attorney, Agent, or Firm* — Alston & Bird LLP

(57) ABSTRACT

A method for the production of a multi-polar shielded electric interface, particularly a plug-in connection, such as a plug, a socket, a Y-part, a T-part, or the like comprising at least one cable (2) connected thereto with a shielding (1), the interface comprising electric contacts (4) and with the cable (2) with the electric contacts (4) comprising conductors (3) to be connected and a shielding (1) surrounding the conductors (3), to be guided from the cable (2) to the interface, wherein to form a shielding element (6) the shielding (1) of the cable (2) and at least an area adjacent to the shielding (1) around the electric contacts (4) is coated by injection molding with an electrically conductive composite material, with the shielding element (6) being distanced from the electric contacts (4) or an isolating body (5) being embedded. An interface is produced accordingly.

16 Claims, 8 Drawing Sheets

Figure 1A:
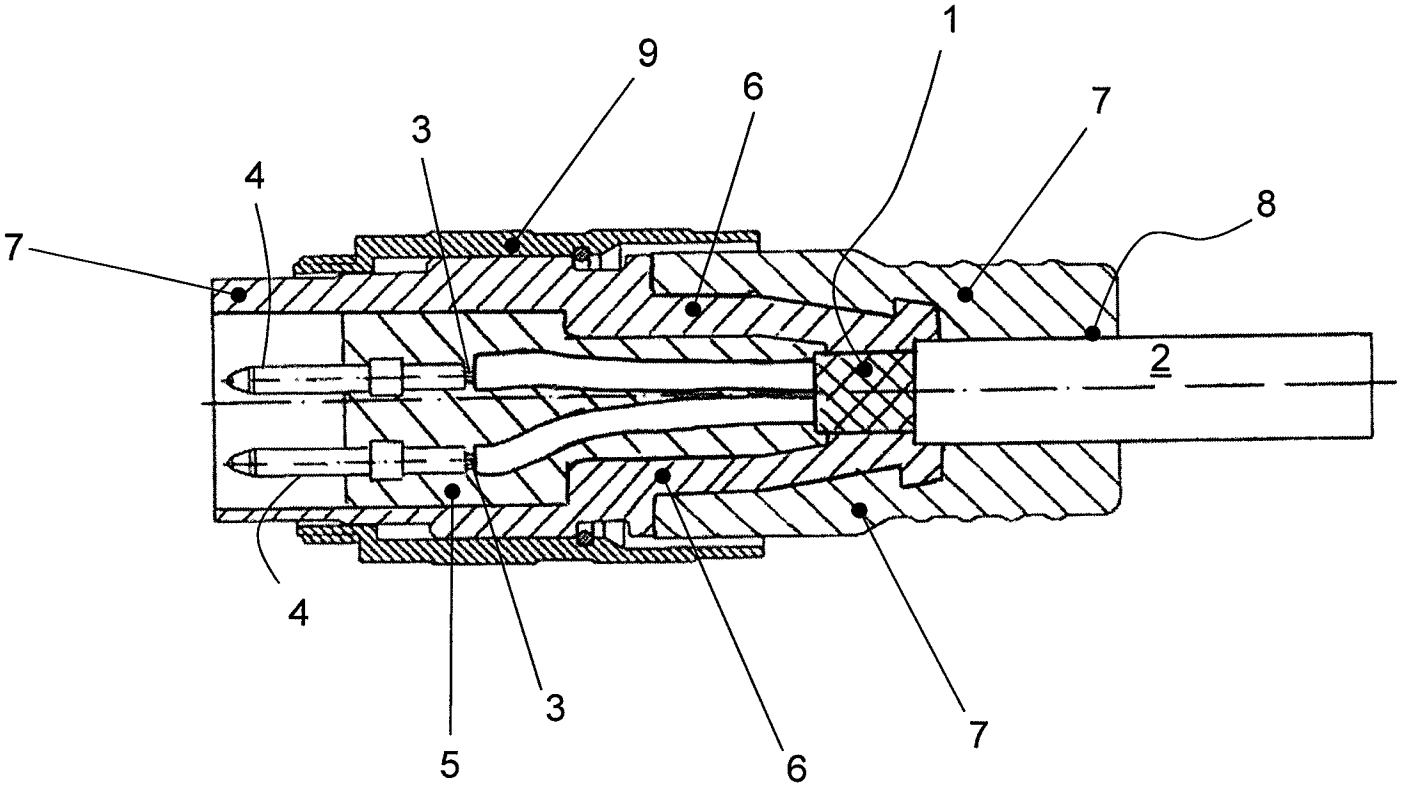

(51) Int. Cl.

| | |
|---|---|
| ***H01R 4/00*** | (2006.01) |
| ***H01R 4/58*** | (2006.01) |
| ***H01R 9/03*** | (2006.01) |
| *H01R 9/05* | (2006.01) |
| *H01R 13/03* | (2006.01) |
| *H01R 43/16* | (2006.01) |

(56) References Cited

U.S. PATENT DOCUMENTS

| | | | | |
|---|---|---|---|---|
| 5,358,417 | A | 10/1994 | Schmedding | |
| 5,395,267 | A | 3/1995 | Tregoning | |
| 5,906,513 | A | 5/1999 | Peterson et al. | |
| 5,980,329 | A | 11/1999 | Klein et al. | |
| 6,269,539 | B1 * | 8/2001 | Takahashi et al. | 29/883 |
| 6,280,227 | B1 | 8/2001 | Terada et al. | |
| 6,577,236 | B2 * | 6/2003 | Harman | 340/552 |
| 6,790,526 | B2 * | 9/2004 | Vargo et al. | 428/343 |
| 6,936,191 | B2 * | 8/2005 | Fox et al. | 252/512 |
| 6,942,516 | B2 | 9/2005 | Shimoyama et al. | |
| 7,150,098 | B2 * | 12/2006 | Borgstrom et al. | 29/874 |
| 7,255,591 | B2 | 8/2007 | Schreier | |
| 7,374,460 | B1 | 5/2008 | Hariharesan et al. | |
| 7,393,218 | B1 | 7/2008 | Pavlovic et al. | |
| 7,540,775 | B2 | 6/2009 | Eckel et al. | |
| 7,607,942 | B1 * | 10/2009 | Van Swearingen | 439/578 |
| 8,011,954 | B2 | 9/2011 | Nagafuchi | |
| 2004/0094605 | A1 | 5/2004 | Wild et al. | |
| 2008/0153356 | A1 | 6/2008 | Chazottes | |
| 2008/0254682 | A1 | 10/2008 | Nickol et al. | |
| 2009/0023339 | A1 * | 1/2009 | Kameyama et al. | 439/609 |
| 2009/0068891 | A1 | 3/2009 | Osenberg | |

FOREIGN PATENT DOCUMENTS

| | | | |
|---|---|---|---|
| CN | 1510800 | A | 7/2004 |
| CN | 1645685 | A | 7/2005 |
| CN | 1806372 | A | 7/2006 |
| CN | 101015097 | A | 8/2007 |
| CN | 101107752 | A | 1/2008 |
| CN | 101291025 | A | 10/2008 |
| CN | 101569063 | A | 10/2009 |
| DE | 10350763 | A1 | 6/2004 |
| DE | 202007005264 | U1 | 8/2008 |
| EP | 0412412 | A1 | 2/1991 |
| EP | 1143577 | A2 | 10/2001 |
| EP | 1168524 | A2 | 1/2002 |
| EP | 1662621 | A1 | 5/2006 |
| GB | 2330021 | A | 4/1999 |
| WO | WO 94/13035 | A1 | 6/1994 |
| WO | WO 2006/005398 | A1 | 1/2006 |
| WO | WO 2008/061572 | A2 | 5/2008 |
| WO | WO 2009/084350 | | 7/2009 |

OTHER PUBLICATIONS

The International Bureau of WIPO, International Preliminary Report on Patentability for International Application No. PCT/DE2011/000203, issued Sep. 25, 2012, 13 pages, Switzerland.

The International Bureau of WIPO, Written Opinion for International Application No. PCT/DE2011/000203, mailed Oct. 5, 2011, 11 pages, Switzerland.

International Searching Authority, International Search Report for International Application No. PCT/DE2011/000203, dated Oct. 5, 2011, 12 pages, European Patent Office, The Netherlands.

International Searching Authority, Written Opinion for International Application No. PCT/DE2011/000203, dated Oct. 5, 2011, 10 pages, The Netherlands.

* cited by examiner

METHOD FOR PRODUCING AN ELECTRIC INTERFACE AND INTERFACE

CROSS REFERENCE TO RELATED APPLICATIONS

This application is a national stage application, filed under 35 U.S.C. §371, of International Application No. PCT/DE2011/000203, filed Mar. 1, 2011, which claims priority to German Application No. 10 2010 009 766.7, filed Mar. 1, 2010, all of which are hereby incorporated by reference in their entirety.

BACKGROUND

1. Technical Field

The invention relates to a method for producing a multi-polar shielded electric interface, particularly a plug-in connection, such as a plug, a socket, a Y-part, T-part, or the like, comprising at least one cable connected (thereto) with a shield, with the interface comprising electric contacts and with the cable comprising conductors to be connected to the electric contacts and a shield surrounding the conductors, leading from the cable to and/or into the interface.

Furthermore, the invention relates to a shielded electric interface, particularly a plug-in connection, such as a plug, socket, Y-part, or the like, comprising at least one electric cable with a shielding connected thereto, with the interface comprising electric contacts and with the cable with the electric contacts comprising conductors/bunched conductors to be connected and a shielding surrounding the conductors, particularly an interface, which is produced according to the method of the invention.

The term "electric interface" shall be understood in the widest sense of the word. Here, it may represent for example a single or multi-polar shielded plug-in connection or a so-called Y-connection or T-connection and/or an appropriate connection part. In order to realize a shielding as good as possible regularly a 360°-shielding of the housing is required, for example by way of a shielding bunched conductor.

2. Description of Related Art

In general, there are various options to provide the most different interfaces and/or plug-in connections with sufficiently good shielding, in particular, for plugs with complicated geometries. For example, in angular plugs, T-connectors and Y-splitters the realization of a 360° shielding to be transferred from the cable to the interface is extremely cumbersome and thus expensive in the production and/or the completion of the interface.

In practice most various interfaces are known, for example in the form of plugs. Here, merely as examples, reference is made only to WO 2008/061572 A2 or DE 20 2007 005 264 U1. WO 2006/005398 A1 shows the complicated manner how a bunched conductor is transferred to the plug-in connection. The same applies for EP 0 412 412 A1.

Analyzed alone, it is known from DE 103 50 763 A1 to produce coax cables with angular plug-in connections with the cable connected to the actual plug-in connection being inserted in a cavity of an injection mold describing a 90°-arch and being surrounded by a thermoplastic material in an injection molding process. Any shielding must be inserted into the actual plug-in connection prior thereto and here be fastened in a conventional fashion. This is expensive.

Regularly, half-shells are provided to form the plug-in housing, with the actual cable chamber being at least partially injection molded. The shield contacting occurs regularly by way of crimping, clamping, or soldering the exposed, wire-woven shield to the housing and/or to a separate shielding sheath.

The electric contacting as well as the contacting of the shielding frequently occurs via punched or bent parts, for example with integrated crimping claws, which are bent by 90° in order to realize a bent plug. Frequently it is necessary to solder seams of the respective housing parts developing here in order to achieve a sufficiently conductive connection and simultaneously sufficient stability.

From practical applications it is already known to use shrink wrap with metallization layers around a shielding. Additionally, adhesive copper tapes are used, which are later (coated by way of) injection molding.

The interfaces of prior art, particularly plug-in connections, are primarily problematic with regards to the production, because it is extremely expensive and complicated to realize a shielding for a cable guided into the interface, to complete and/or assemble the components in an appropriate fashion. The production method is cumbersome and thus expensive, particularly when the interfaces represent miniaturized interfaces in the form of minute plug-in connections.

BRIEF SUMMARY

The present invention is based on the objective to provide a method for producing a multi-polar shielded electric interface, particularly a plug-in connection, such as a plug, a socket, a Y-part, a T-part, or the like, according to which a respective interface can be produced in a simple fashion and thus cost-effectively. Furthermore, a respectively produced interface shall be provided.

The above objective is attained in a method with the features as defined in the claims. Accordingly the method according to the invention is attained such that in order to form a shielding element the shielding of the cable or the cables and at least one area adjacent to said shielding around the electric contacts is coated with an electrically conductive composite material by way of injection molding, with the shielding element may be distanced in reference to the electric contacts or may be insulated by embedding an insulating body, with both a coating of contacts by way of injection molding as well as the use of an inserted part with inserted contacts being possible.

Regarding to the interface according to the invention the above-stated objective is attained in the features as defined in the claims. Thus, the interface is characterized in that the shielding element is formed by coating the shield of the cable by way of injection molding and at least one area adjacent to the shielding around the electric contacts using an electrically conducting composite material, with the shielding element being distanced from the electric contacts or, by embedding an insulating body, is insulated according to the explanations in the previous paragraph.

According to the invention it has been recognized that the shielding originating in the cable can be guided very easily into the electric interface, for example into the plug, into the socket, or the like, namely such that in order to form a shielding element the shielding of the cable or perhaps, in case several cables and at least one area around the electric contacts adjacent to the shielding is coated by way of injection molding with an electrically conductive composite material. Here, it must be observed that the shielding element is distanced from the electric contacts or insulated by the use of an insulating body.

According to the invention a connection to the shielding of the cable is achieved by injection-molding technology, although the thermoplastic materials common in injection molding showing hardly any electrically conductive features. Accordingly, here a composite material is used, which is electrically conductive and suitable for injection molding. Thus, the injection molding process serves, on the one hand, for an electric contacting of the shielding and, on the other hand, for the shaping so that it is not necessary to crimp the shielding, solder a shielding ring thereat, or in any other manner connect the electrically conductive components of the interface or the other electrically conductive housing parts of the interface.

The composite material serving for the injection molding and thus the production of the shielding element can be injection molded and comprises metallic components, with here it being necessary that after the injection molding an electrically conductive surface, a metallic matrix, or a metallic dispersant is present conductive in the sense of a diffusion compound. Here, the composite material with a low-melting metal is suitable, with it showing a melting point below 200° C. A eutectic or peritectic structure with a low melting point is here particularly suitable.

Furthermore, the composite material shall comprise a thermoplastic material, which ultimately forms a type of matrix. The processing temperature, i.e. the temperature of the injection molding process should range from 250° C. to 300° C. It is also possible that the composite material comprises electrically conductive particles, particularly metallic fibers and/or metallic pellets, with the conductivity and thus the suitability of the composite material is promoted for the production of the shielding element by way of injection molding.

According to the invention, here a composite material is used for coating by way of injection molding and contacting the shielding of the cable by which conventional contacts and/or connections to an interface housing are no longer necessary. Thus, a technically easier production is realized.

With regards to the composite material used it shall be mentioned that the thermoplastic material with a portion of 10 to 25% by weight, the low-melting metal with a portion of 10 to 40% by weight, and the other "additives" with 30 to 75% by weight may be provided, with the material being included as "additives", particularly steel or copper fibers or respective pellets, promote the formation of an electrically conductive framework. With such a composite, after the injection molding process, a specific electric conductivity can be yielded with up to $10^6$ S/m and a thermal conductivity >10 W/mK. Thus, an appropriately produced and/or injection molded shielding element is particularly suitable to form the shielding of the cable at respective components of a conventional interface.

Within the scope of the method according to the invention first the cable is conventionally confectioned, then the conductors, particularly the stranded wires included in the conductors, and the shielding are exposed at the ends, with the electric insulation between the stranded wires and the shielding remaining.

In order to form the electric contacts the conductors and/or the stranded wires of the conductor may be crimped. It is also possible that the stranded wires are coated by way of injection molding with an electrically conductive material. This may represent the same material from which the shielding element is produced in an injection-molding fashion and here the cable is formed thereat. Complicated wirings and connections can be produced automatically, compared to conventional, usually manual methods, thus a considerable simplification of the production and therefore a reduction of the production costs can be achieved, here.

The cables are confectioned as in prior art, and inserted into the injection-molding tool. The contacting of the individual stranded wires could also a part of a multi-component injection molding process, which is discussed in greater detail in the following. Bridges, lateral bars, other connections may be inserted or connected and/or contacted in an injection-molded fashion. In any case, the generation of the contact pins by way of injection molding directly onto the stranded wires, with it here being possible to produce even geometrically complicated shaped contacts. Arbitrary profiles of the contact pins can be realized. A particular crimping or soldering process is no longer necessary, here, when the electric contacts on the stranded wires are produced in an injection-molding process.

When the electric contacts have been produced, in whatever form, they are at least partially embedded in an insulating body made from plastic, for example an insert part, with this not being mandatory, though. In case of a technical injection-molding embodiment of such an insulating body it forms a type of interface body, for example a plug/socket body, with a first shaping of the interface occurring, here. The interface body comprises an insulating plastic and is connected to the cable with an integration of the electric contacts in a technical injection-molding process. The free end of the cable and the previously formed contacts are embedded, at least partially, in the insulating body and positioned according to the contacting required for operation.

Furthermore, it is advantageous if functional elements, such as latching cams, springs, or the like are integrated in the interface body during its molding process. A latching cam may be produced from the same material as the interface body itself, namely molded and/or integrated in a technical injection-molding process, for example projecting inwardly. It is also possible to insert a separate spring element into the injection mold and to coat it accordingly, with here an arbitrary positioning of the spring element being possible.

In another step it is possible for the interface body formed according to the above-stated explanations to comprise an electrically isolating material (plastic), forming the above-mentioned shielding elements at least partially from the electrically conductive composite material by way of injection molding. Concretely it is possible to insert the cable with the interface body created at the end once more into an injection molding tool such that at least the shielding projection from the cable insulation and/or the shielding web forming the shielding as well as the interface body are coated by way of injection molding. With this measure the shielding element is embodied, namely the shielding of the cable is inserted completely in the interface, depending on the scope of the interface body, comprising a non-conducting plastic, being coated by way of injection molding with an electrically conducting composite material.

Depending on requirements, it is possible that the cable is coated with an electrically isolating plastic in an injection molding process in front of and/or in the area of the shielding element and at least a part of the shielding formed according to the above-stated explanations, forming the exterior shape of the interface and/or plug-in connection, i.e. forming a housing. This plastic may surround an area of the end of the cable and a part of the shielding element or the entire shielding element with the interface body located underneath thereof. By this measure ultimately the exterior shape of the interface body is defined, for example a straight or angular plug. For example it is possible that the housing is injection molded in arbitrary shapes, for example in the form of an angular plug, including a part of the cable, thus the production of the interface with a connected cable is completed. The housing may represent a flange housing, i.e. the counterpart of a coupling plug.

At the free end, i.e. at the open face of the interface developing here, arbitrary components can be plugged on and/or plugged at or screwed to and/or screwed in, for example a threaded ring made from metal. Arbitrary coupling parts, adapters, etc. can be combined with said interface.

The interface produced according to the above explanations can be produced in injection molding processes independent from each other in separate tools. Additionally, it is possible that at least two different areas of the interface adjacent to each other are simultaneously produced in a single injection molding tool, for example in the overmolding process. Several different areas can also be produced simultaneously by way of injection molding, with the electric contacting as well as at least the shielding and the actual molding occurring in a single processing step of injection molding technology. Expensive assemblies and/or completions, in prior art primarily performed manually, are no longer necessary in the method according to the invention.

Here, it shall be mentioned that the method according to the invention relates both to the coating by way of injection molding as well as the plug body as an inserted part.

A shielded electric interface is claimed, which is produced by a method according to the invention. For the interface the shield element is formed by way of coating the shielding of the cable and at least one area adjacent of the shielding by injection molding in order to form the electric contacts with the electrically conductive composite material. The shielding element is distanced from the electric contacts or isolated with an isolating body being integrated, which is not mandatory, though.

As already explained for the method according to the invention the composite material comprises metallic binders as composite materials, with after the injection molding a metallic surface, a metallic skeleton, and/or a metallic dispersant is realized in the sense of a penetrable structure. The composite material comprises a low-melting metal, showing a melting point below 200° C. as well as a thermoplastic material with a processing temperature (injection molding temperature) ranging from 250° C. to 300° C. Additional electrically conductive components, such as metallic fibers or metallic pellets, promote the electric conductivity and the features required for shielding.

In the interface according to the invention the contacts may be embedded at least partially in an isolating body by way of injection molding, with the isolating body forming an interface body, particularly a plug/socket body. Functional elements, such as latching cams, springs, or the like may be integrated in the interface body. Threads and other coupling mechanisms serving as connections can be integrated as well.

The interface body is coated, at least partially, by injection molding and forming a shielding element, with the cable being coated by injection molding in front of and/or in the area of the shielding element and at least a portion of the shielding element under the formation of the outer shape of the interface and/or the plug-in connection with an electrically non-conductive plastic. By this measure ultimately a housing is formed. The housing may be molded in any arbitrary shape, for example realizing an angular plug or an angular socket.

DETAILED DESCRIPTION OF THE DRAWINGS

There are various options to embody and further develop the teaching of the present invention in an advantageous manner. For this purpose, reference is made on the one hand to the claims and on the other hand to the exemplary embodiments of the invention explained in the following based on the drawing. Generally various embodiments and further developments of the teaching are also explained in connection with the explanation of the exemplary embodiments of the invention based on the drawing. The drawing shows FIG. 1*a* in a schematic view, cross-sectioned, an exemplary embodiment of an interface according to the invention in the form of a plug, in which a threaded ring is provided at the end, with the isolating body being produced by coating contacts by way of injection molding, FIG. 1*b* in a schematic view, partially cross-sectioned, another exemplary embodiment of an interface according to the invention in the form of a plug, in which a threaded ring is provided at the end side, with the isolating body being embedded as an inserted part, FIG. 2 in a schematic view, cross-sectioned, another exemplary embodiment of an interface according to the invention in the form of a plug, with here both at the outside as well as the inside latching cams and a shielding element are embodied, FIG. 3 in a schematic view, cross-sectioned, another exemplary embodiment of an interface according to the invention in the form of a plug, with here in the interior a spring latch is embedded by way of injection molding technology, FIG. 4*a* in a schematic view, cross-sectioned, another exemplary embodiment of an interface according to the invention as a distributor in the form of an angular plug with a screw cap, FIG. 4*b* in a schematic view, cross-sectioned, another exemplary embodiment of an interface according to the invention as a distributor in the form of an angular plug with an electrically conductive latching element directly formed thereat and/or a shielding element directly injection molded thereat, FIG. 4*c* in a schematic view, cross-sectioned, another exemplary embodiment of an interface according to the invention as a distributor in the form of an angular plug, with a metal insert part (latching cams, shield element for 360° shielding) being coated by injection molding, and FIG. 5 in another schematic view, cross-sectioned, another exemplary embodiment of an interface according to the invention in the form of a Y-part with three cables embedded.

DETAILED DESCRIPTION OF VARIOUS EMBODIMENTS

FIG. 1*a* shows a first exemplary embodiment of an interface produced by the method according to the invention in the form of a plug, with here the shielding 1 of a cable 2 is guided in the interface. FIG. 1 shows clearly that a frontal area of the shielding 1 is isolated so that a direct contacting is possible.

Electrically isolated conductors 3 further project into the interface and/or the plug and are embodied at their ends with contacts 4 by way of crimping, soldering, etc. or coated by injection molding.

In order to position the electric contacts 4 and to embed them in the plug an isolating body 5 has been created by injection molding comprising plastic, in which the electric contacts 4 are integrated with their crimp connection. The isolating body 5 ultimately forms an interface body, based on which additional functional areas can be created by way of injection molding.

The isolating body 5 is molded in the manner according to the invention to form a shielding element 6 with an electrically conductive composite material, also by way of injection molding, with the shielding element 6 generated in this manner electrically contacting the shielding 1 and guiding it via the isolating body 5 into the interface and/or along it.

An isolating body 7 can also be produced by way of injection molding as another component, namely from an electrically isolating plastic. The housing 7 embeds the cable isolation 8 and seals tightly in reference thereto. The housing 7 extends from the cable isolation 8 at least partially beyond the shielding element 6 and can form a stop for an end-side assembly of a threaded ring 9 or the like. It is also possible that the housing 7 produced by injection molding technology extends over the entire shielding element 6 to the frontal end of the shielding element 6 and thus covers it entirely. Any other embodiments and forms are also possible.

Figure 1B:
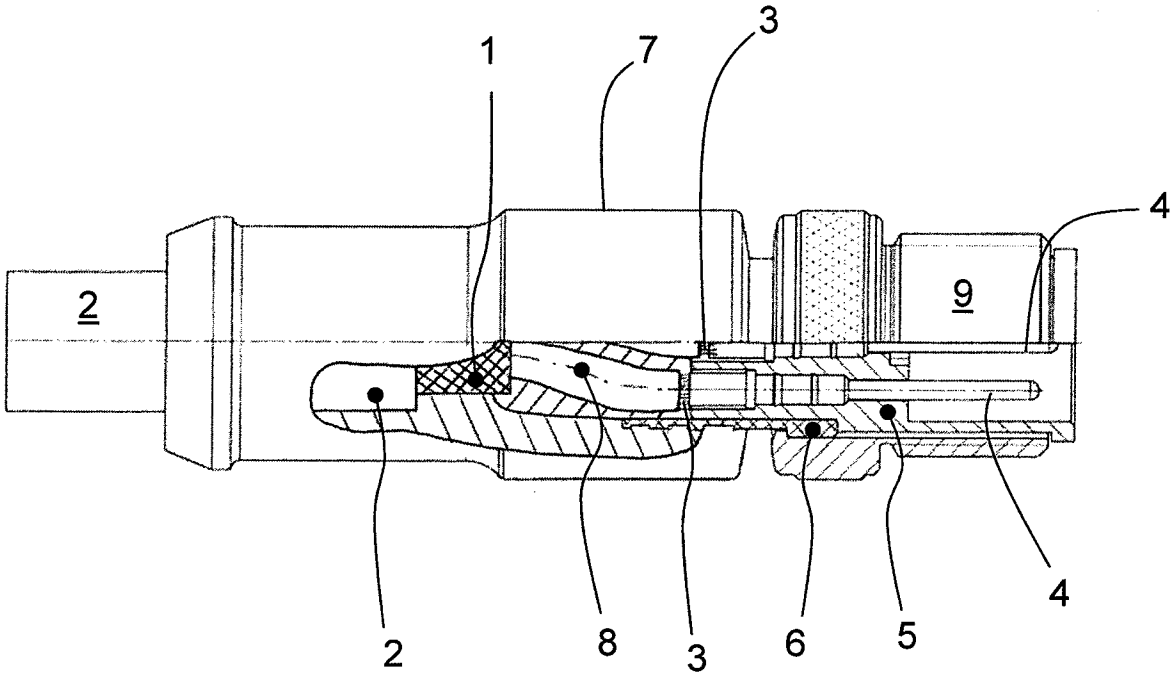

FIG. 1*b* shows another exemplary embodiment in an interface, produced according to the method of the invention, in the form of a plug, with here, unlike in the exemplary embodiment according to FIG. 1*a*, the isolating body 5 is inserted as an insert part in the sense of an "external" isolating body. The isolating body 5 provided here is equivalent to a plug-in body in the sense of an insert part. In the concrete case, here the conventionally produced plug-in body is equipped with electric contacts 4. The conductors 3 are soldered. An isolation is provided in the cable chamber. The shielding element 6 is injection molded, as is the exterior contour determining the shape.

Figure 2:
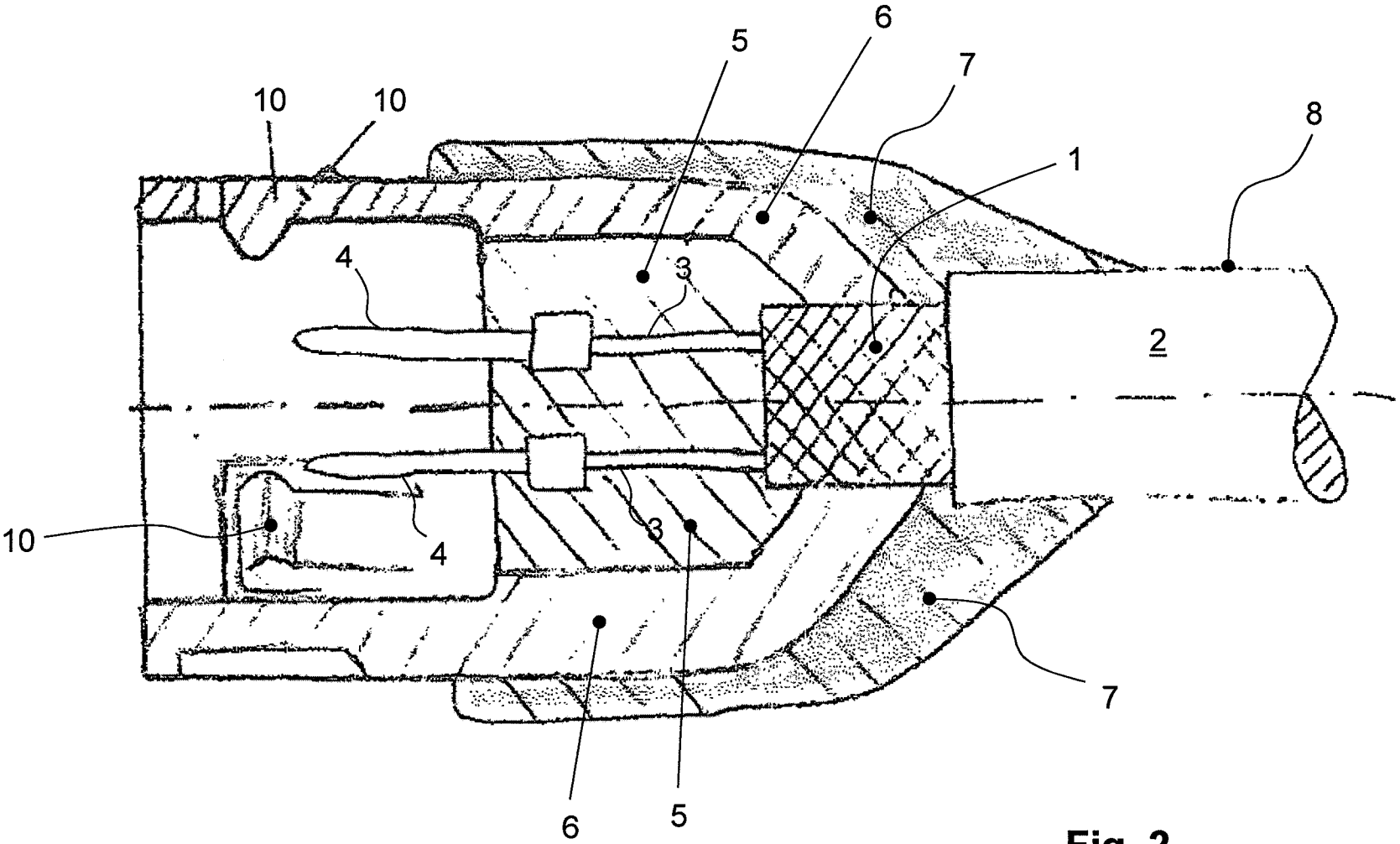

FIG. 2 shows another embodiment of an interface according to the invention in the form of a plug, with here the shield element 6 being embodied longer and thus extends considerably farther beyond the isolating body 5 compared to the embodiments according to FIGS. 1*a* and 1*b*. For a secure coupling, according to FIG. 2 latching cams 10 are realized, namely formed by way of injection molding. An electrically conductive latching unit can also be integrated via a latching hook. Additionally, the integration of one or more elastically embodied, radially arranged contact cams in the form of injection molded shielding elements is possible, with their return forces pressing against the flange housing and thus a circumferential shielding is realized inside the interface. The provision of an additional elastic ring is possible, which may also be embedded by way of injection molding.

According to the above explanations the number of transfer resistances can be considerably reduced.

Figure 3:
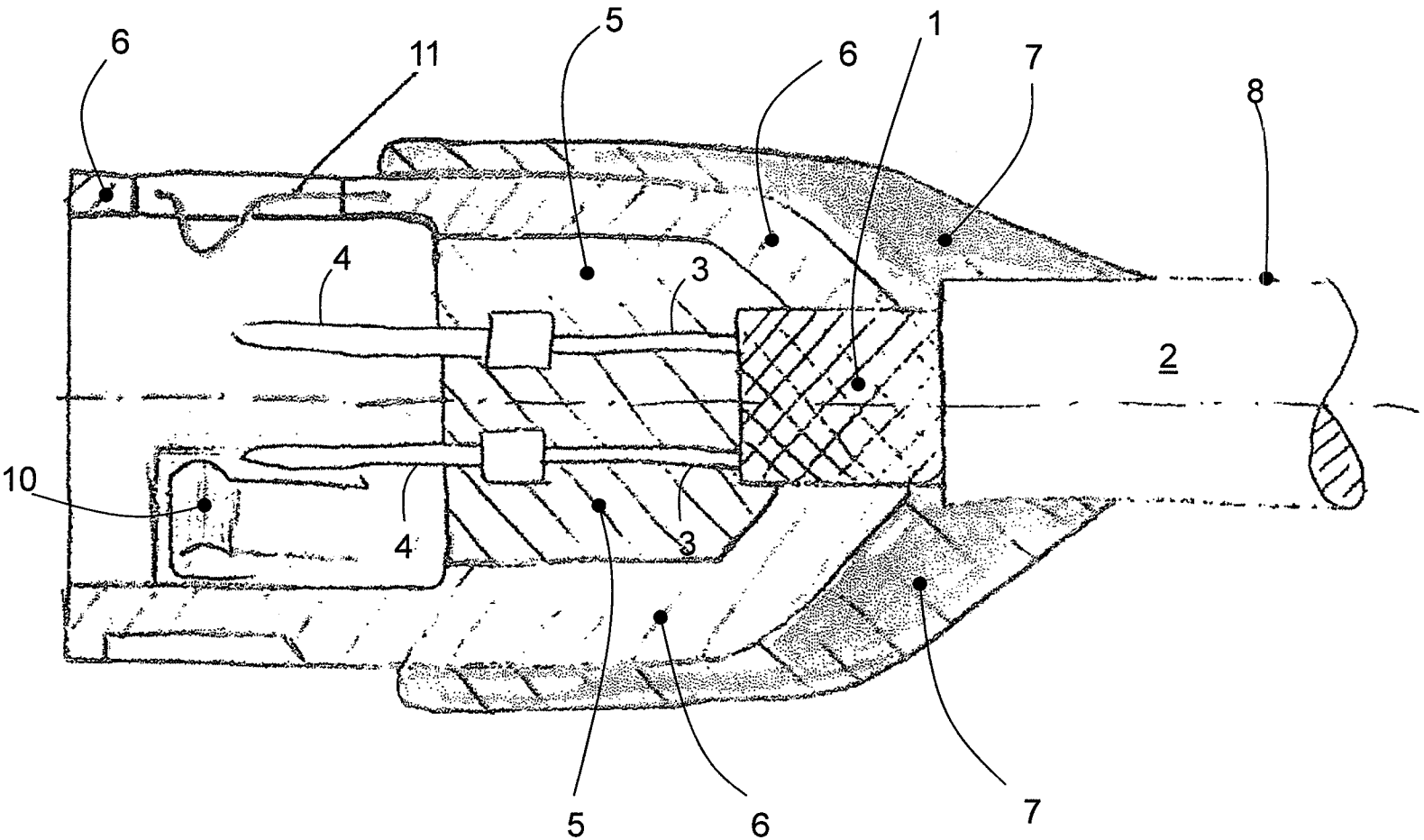

FIG. 3 shows another exemplary embodiment of an interface according to the invention in the form of a plug, with here, contrary to the embodiment shown in FIG. 2, a spring 11 is provided in the extended shielding element 6 by way of injection molding. Here, it shall be mentioned that the electric contact of the above-mentioned functional elements can be realized for shielding and/or conducting current by way of coating a metal insert part using injection molding. Additionally, it is advantageous when elastic elements, for example a spring, is provided with an abrasion-resistant surface in order to allow realizing, namely on the one side a long-lasting return force, and on the other side a flow resistance as low as possible. A long-lasting return force can be realized by a suitable spring material showing the respective mechanic features. A flow resistance as low as possible can be realized, for example, by an additional suitable surface.

Figure 4A:
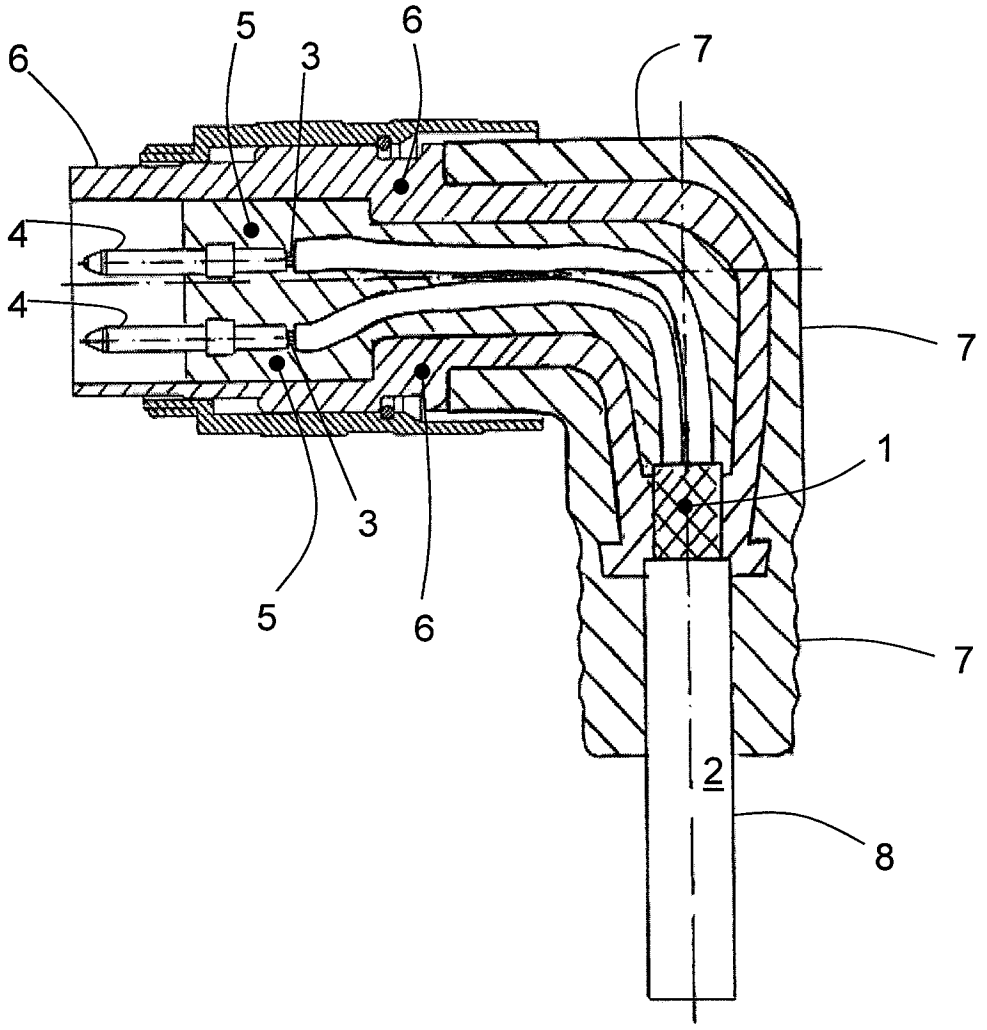

FIG. 4*a* shows in a schematic view another exemplary embodiment of an interface according to the invention, here in the form of an angular plug. FIG. 4*a* shows clearly that by the design of the housing 7 by way of injection molding an angular plug has been realized, with the housing 7 in its design also embedding the shield element 6 in the overall shape generated by way of injection molding.

Figure 4B:
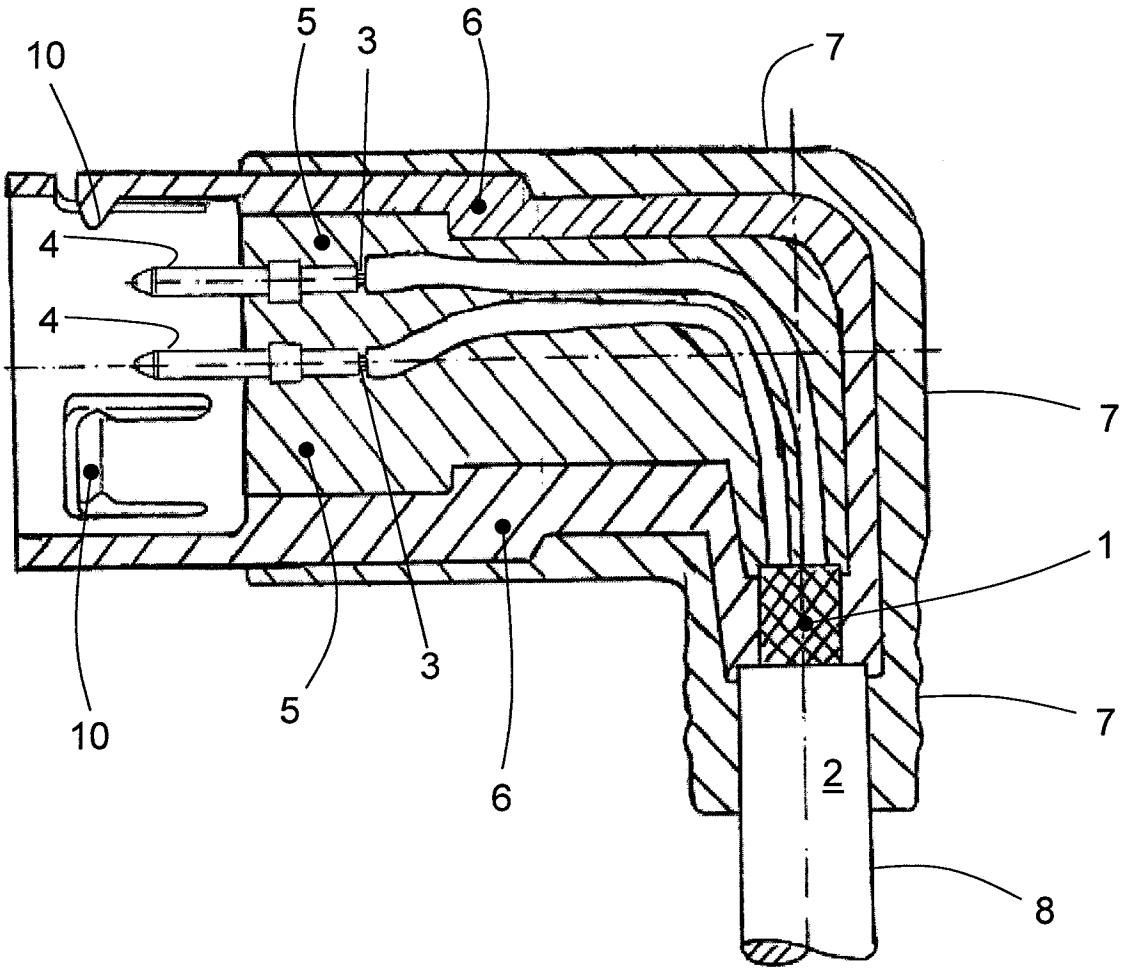

FIG. 4*b* shows another exemplary embodiment of an interface according to the invention in a schematic view in the form of an angular plug, with here an electrically conductive latching unit being provided in the form of latching cams 10 and a directly injection molded shielding element 6.

Figure 4C:
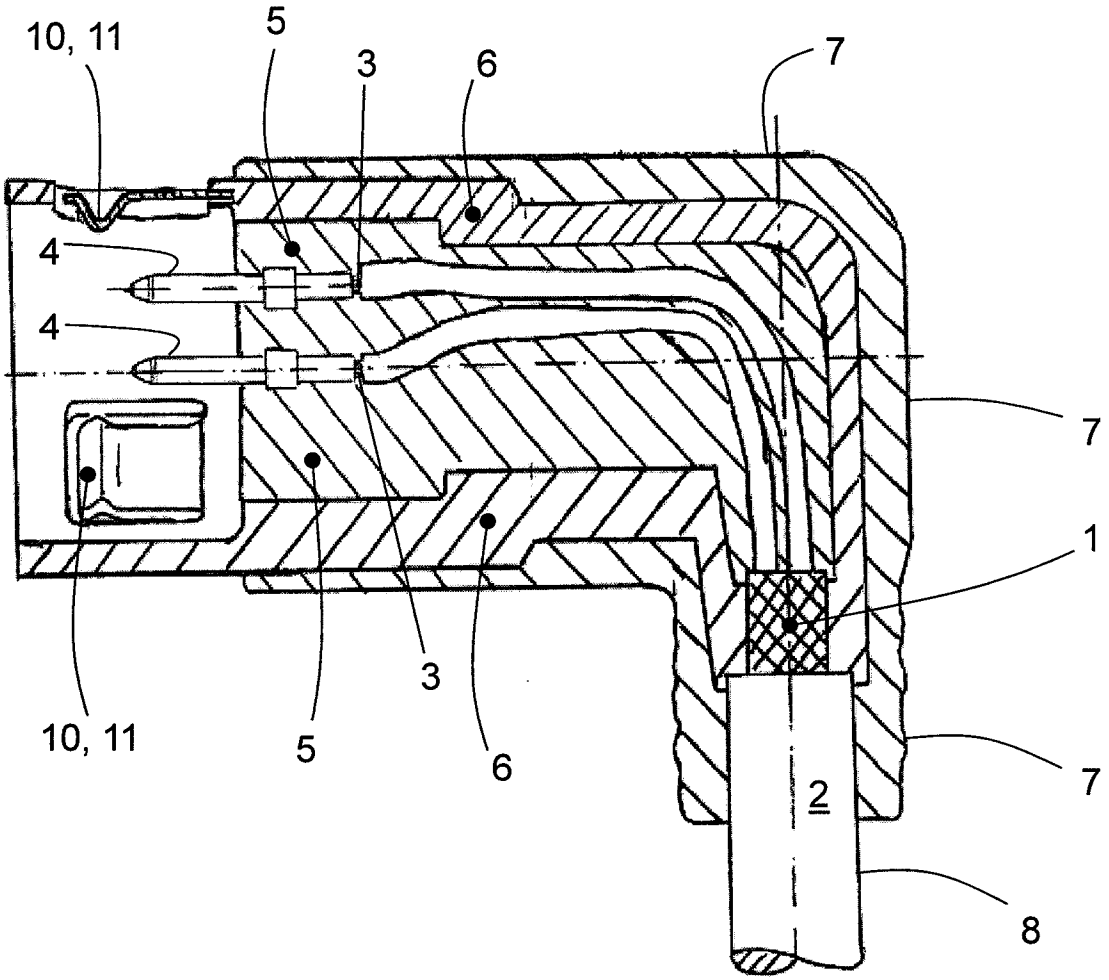

FIG. 4*c* shows another exemplary embodiment of an interface according to the invention as a distributor in the form of an angular plug, with here a metallic insert part 13 serving as the latching hook. The metallic insert part 13 is embedded in the injection molded shielding element 6.

Figure 5:
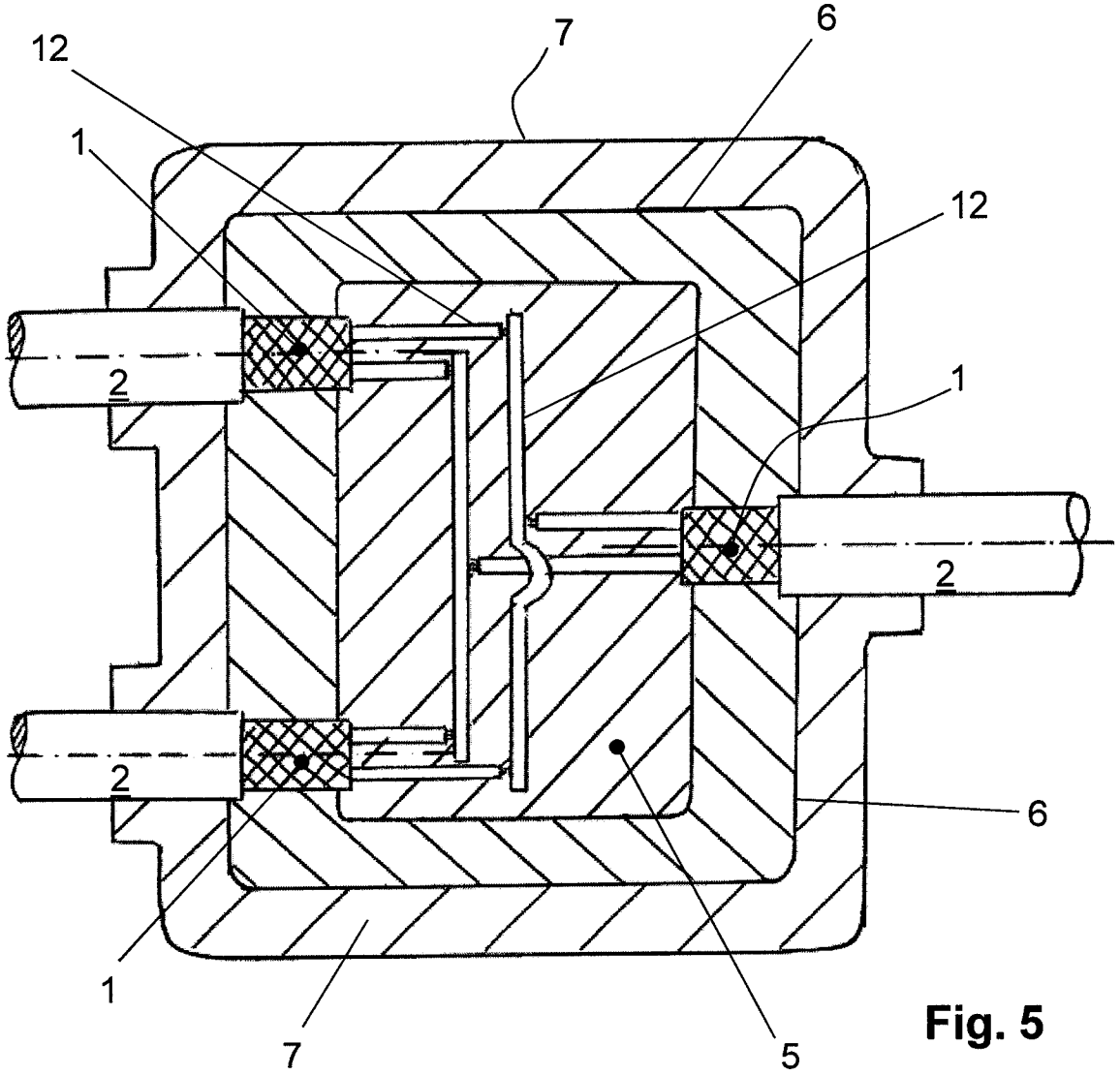

Finally, FIG. 5 shows in a schematic view a distributor in the form of a Y-part, with here a total of three cables 2 are electrically coupled to each other. The interface comprises various functional elements in the form of bridges 12, which are positioned over the isolation body 5 produced by way of injection molding and electrically isolated from each other. The free ends of the cables 2 are embedded in the isolating body 5, which forms the interface body.

The isolating body 5 is overall surrounded with a shielding element 6 produced by injection molding, which contacts the respective shielding 1 of the cables 2 and embedding them accordingly.

The exterior shape is realized by the also injection molded housing 7, namely from an electrically isolating plastic material. The form of the interface and/or the Y-part is therefore defined by injection molding technology, namely by the housing 7.

It shall be mentioned that the above-discussed exemplary embodiments only serve to explain the claimed teaching by way of examples, however the teaching not being limited thereto.

LIST OF REFERENCE CHARACTERS

1 shielding
2 cable
3 conductor (of the cable)
4 electric contact
5 isolating body, interface body
6 shielding element
7 housing
8 cable isolation
9 threaded ring
10 latching cam
11 spring
12 bridge
13 metallic insert part

The invention claimed is:

1. A method for producing a shielded electric interface comprising a plurality of electric contacts, at least one cable comprising a plurality of conductors each in electrical communication with one of the plurality of electric contacts and a shielding surrounding the conductors, the method comprising:

injection molding an electrically isolative material to form an isolating body as interface body, wherein the isolating body is produced by coating the plurality of electric contacts such that at least a portion of each of the plurality of electric contacts is embedded in the isolating body; and injection molding an electrically conductive composite material in at least one area adjacent the shielding to form a shielding element, wherein the resulting shielding element is in electrical communication with the shielding, and is electrically isolated from the electric contacts by the isolating body positioned therebetween, wherein the isolating body is coated with the electrically conductive composite material so as to encapsulate each of the plurality of electric contacts embedded in the isolating body further within the coating of the electrically conductive composite material.

2. The method according to claim 1, wherein the composite material comprises metallic components, and wherein said injection molding the electrically conductive composite material additionally comprises forming a permeable metallic matrix.

3. The method according to claim 1, wherein the composite material comprises a metal having a melting point less than 200° C.

4. The method according to claim 1, wherein the composite material comprises a thermoplastic material having a processing temperature between 250° C. and 300° C.

5. The method according to claim 1, wherein the composite material comprises electrically conductive particles selected from the group consisting of: metallic fibers and metallic pellets.

6. The method according to claim 1, wherein each of the at least one cable comprises a plurality of wire strands, the method further comprising:

confecting a portion of the wire strands to form the electric contacts.

7. The method according to claim 6, wherein confecting the wire strands includes a process selected from the group consisting of:

(1) crimping the wire strands to form the electric contacts; and (2) coating, by injection molding, at least a portion of the wire strands with an electrically conductive material to form the electric contacts.

8. The method according to claim 1, wherein the injection molding steps comprise integrating one or more functional elements into the interface body, wherein the one or more functional elements are selected from the group consisting of: latching cams and springs.

9. The method according to claim 1, further comprising the step of: coating an interface body with the electrically conductive composite material by injection molding.

10. The method according to claim 1, further comprising the step of:

coating at least a portion of the cable and at least a portion of the shielding with an electrically isolating plastic by injection molding.

11. The method according to claim 10, further comprising the step of:

injection molding a housing such that the shielding element and at least a portion of the cable is positioned within the housing, wherein the housing comprises an electrically isolating plastic.

12. The method according to claim 1, wherein the shielding element comprises a plurality of areas adjacent the shielding, each of the plurality of areas being injection molded successively.

13. The method according to claim 1, wherein the shielding element comprises a plurality of areas adjacent the shielding, at least two of the plurality of areas being injection molded simultaneously.

14. The method according to claim 1, wherein the shielded electric interface is a multi-polar shielded electric interface.

15. A method for producing a shielded electric interface comprising a plurality of electric contacts, at least one cable comprising a plurality of conductors each in electrical communication with one of the plurality of electric contacts and a shielding surrounding the conductors, the method comprising:

injection molding an electrically isolative material to form an isolating body as interface body, wherein the isolating body is produced by coating the plurality of electric contacts such that at least a portion of each of the plurality of electric contacts is embedded in the isolating body; and injection molding an electrically conductive composite material in at least one area adjacent the shielding to form a shielding element, wherein the resulting shielding element is in electrical communication with the shielding, and is electrically isolated from the electric contacts by the isolating body positioned therebetween, wherein:

the isolating body is coated with the electrically conductive composite material so as to encapsulate each of the plurality of electric contacts embedded in the isolating body further within the coating of the electrically conductive composite material; and the composite material comprises a metal having a melting point less than 200° C.

16. A method for producing a shielded electric interface comprising a plurality of electric contacts, at least one cable comprising a plurality of conductors each in electrical communication with one of the plurality of electric contacts and a shielding surrounding the conductors, the method comprising:

injection molding an electrically isolative material to form an isolating body as interface body, wherein the isolating body is produced by coating the plurality of electric contacts such that at least a portion of each of the plurality of electric contacts is embedded in the isolating body; and injection molding an electrically conductive composite material in at least one area adjacent the shielding to form a shielding element, wherein the resulting shielding element is in electrical communication with the shielding, and is electrically isolated from the electric contacts by the isolating body positioned therebetween, wherein:

the isolating body is coated with the electrically conductive composite material so as to encapsulate each of the plurality of electric contacts embedded in the isolating body further within the coating of the electrically conductive composite material; and the composite material comprises a thermoplastic material having a processing temperature between 250° C. and 300° C.

* * * * *